US006380854B1

(12) United States Patent
Hagerman et al.

(10) Patent No.: US 6,380,854 B1
(45) Date of Patent: Apr. 30, 2002

(54) REMOTE ALARM TESTER

(76) Inventors: Eric Hagerman; Steve Carrick, both of 531 Noriega St., San Francisco, CA (US) 94122

( * ) Notice: Subject to any disclaimer, the term of this patent is extended or adjusted under 35 U.S.C. 154(b) by 0 days.

(21) Appl. No.: 09/584,681

(22) Filed: May 31, 2000

(51) Int. Cl.[7] ..... G08B 21/00

(52) U.S. Cl. ..... 340/540; 340/514; 340/628; 340/332; 340/331

(58) Field of Search ..... 340/540, 628, 340/331, 332, 531, 532, 514, 515

(56) References Cited

U.S. PATENT DOCUMENTS 4,258,291 A * 3/1981 Scott et al. ..... 315/156
4,524,304 A * 6/1985 Todd ..... 315/156
4,570,155 A * 2/1986 Skarman et al. ..... 340/531
5,177,461 A * 1/1993 Budzyna et al. ..... 340/331
6,133,839 A * 10/2000 Ellul, Jr. et al. ..... 340/584

* cited by examiner

*Primary Examiner*—Edward Lefkowitz
(74) *Attorney, Agent, or Firm*—Carol D. Titus; James J. Leary

(57) ABSTRACT

Remote Alarm Tester with A graphic display panel having an attached electronic sound sensing device, the sound sensing device capable of activating an LED light when a sound of seventy five Db or greater has occurred within a ten foot distance of the device, and the graphic display card also displaying pictorial and language elements that communicate to passers by that an inspection is taking place and to not tamper with the sensing device. A preferred embodiment includes wherein said electronic sound sensing device is comprised of a housing, battery, indicating LED's, Microphone, on/off switch, microprocessor chip and associated electronic components.

16 Claims, 5 Drawing Sheets

REMOTE ALARM TESTER

BACKGROUND OF THE INVENTION

This invention relates generally to the field of testing devices, and more particularly to a Remote Alarm Tester.

Alarm devices such as a horn, speaker or bell, have been in existence for many years. Additionally, the presence of multi story building for use as apartments, condominiums, or for business or other uses have increased dramatically over the last fifty years. It has become common practice and law to mandate the installation of fire or smoke alarm devices mounted on the wall or ceilings of hallways on each floor of a building. These alarms become activated when there is evidence of a fire. An industry has grown up around the testing and maintenance of these alarms to make sure that they are functional and up to code.

Presently, the alarm testing procedure can be very time consuming. The tester generally access's a central console located in the lobby of the building or other designated location. The tester must activate each alarm at the central console and then travel to each alarm to make sure it is working, and then go back and turn the alarm off. This process is not only time consuming, it also causes unnecessary disturbance and concern to the residence of the building. A solution to this problem can be to have a second person stationed at the alarm location while the first person activates the alarm at the central console. The two could talk to each other by hand held transmitting and receiving devices. This second option is expensive because two people need to be employed for the job rather than one.

SUMMARY OF THE INVENTION

The primary object of the invention is to provide a remote alarm tester that allows a maintenance person or Fire Alarm Inspector to more easily check the proper functioning of a plurality of emergency alarms in a timely, reliable fashion.

Other objects and advantages of the present invention will become apparent from the following descriptions, taken in connection with the accompanying drawings, wherein, by way of illustration and example, an embodiment of the present invention is disclosed.

Remote Alarm Tester comprising: A graphic display panel having an attached electronic sound sensing device encased within a housing, said sound sensing device capable of activating an LED light when a sound of seventy five Db or greater has occurred within a ten foot distance from said testing device, and said graphic display panel also displaying pictorial and or language elements that communicate to passersby that an inspection is taking place and to not tamper with the sensing device.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
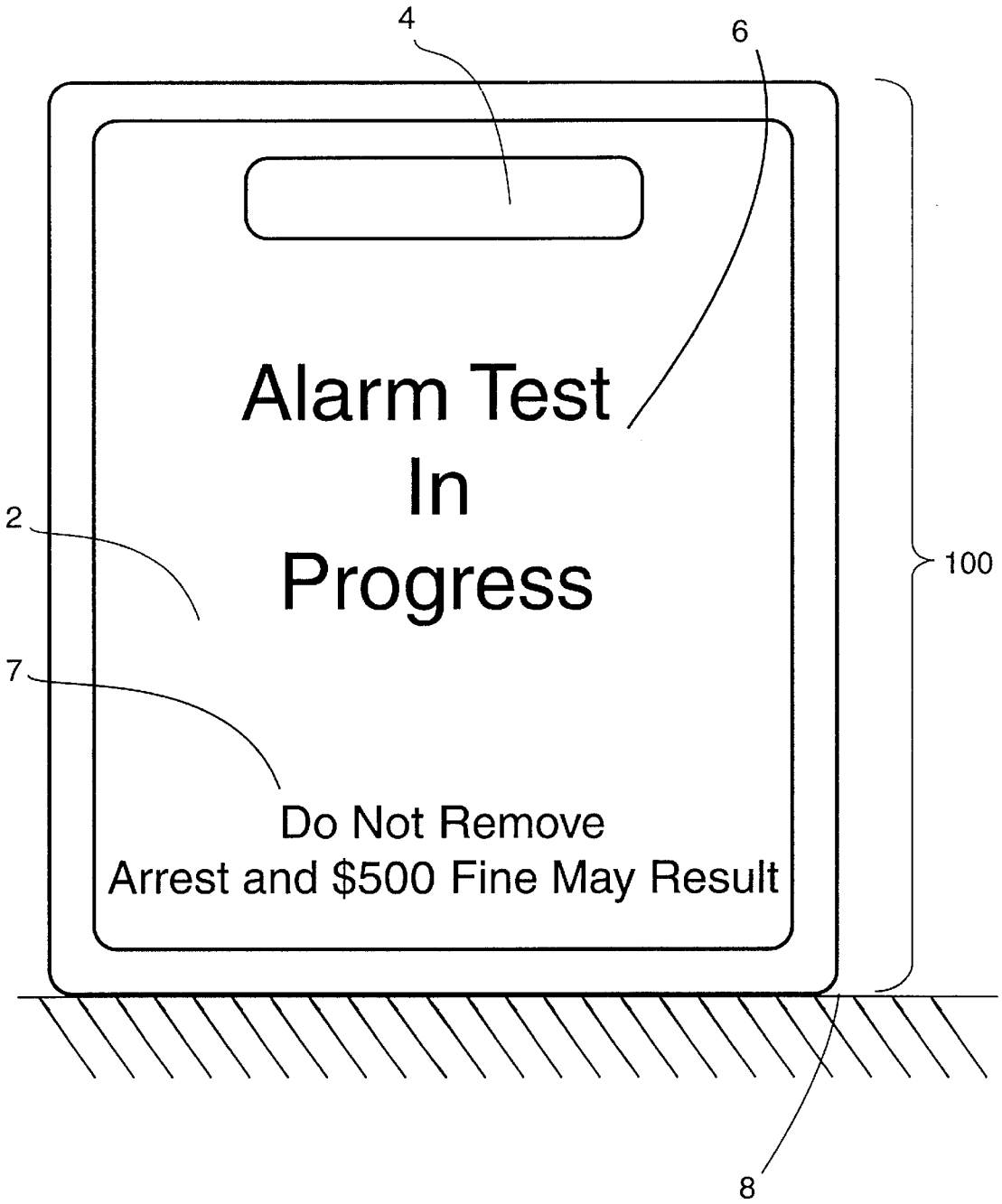
FIG. 1 is a front view of the alarm tester of the present invention.
Figure 2:
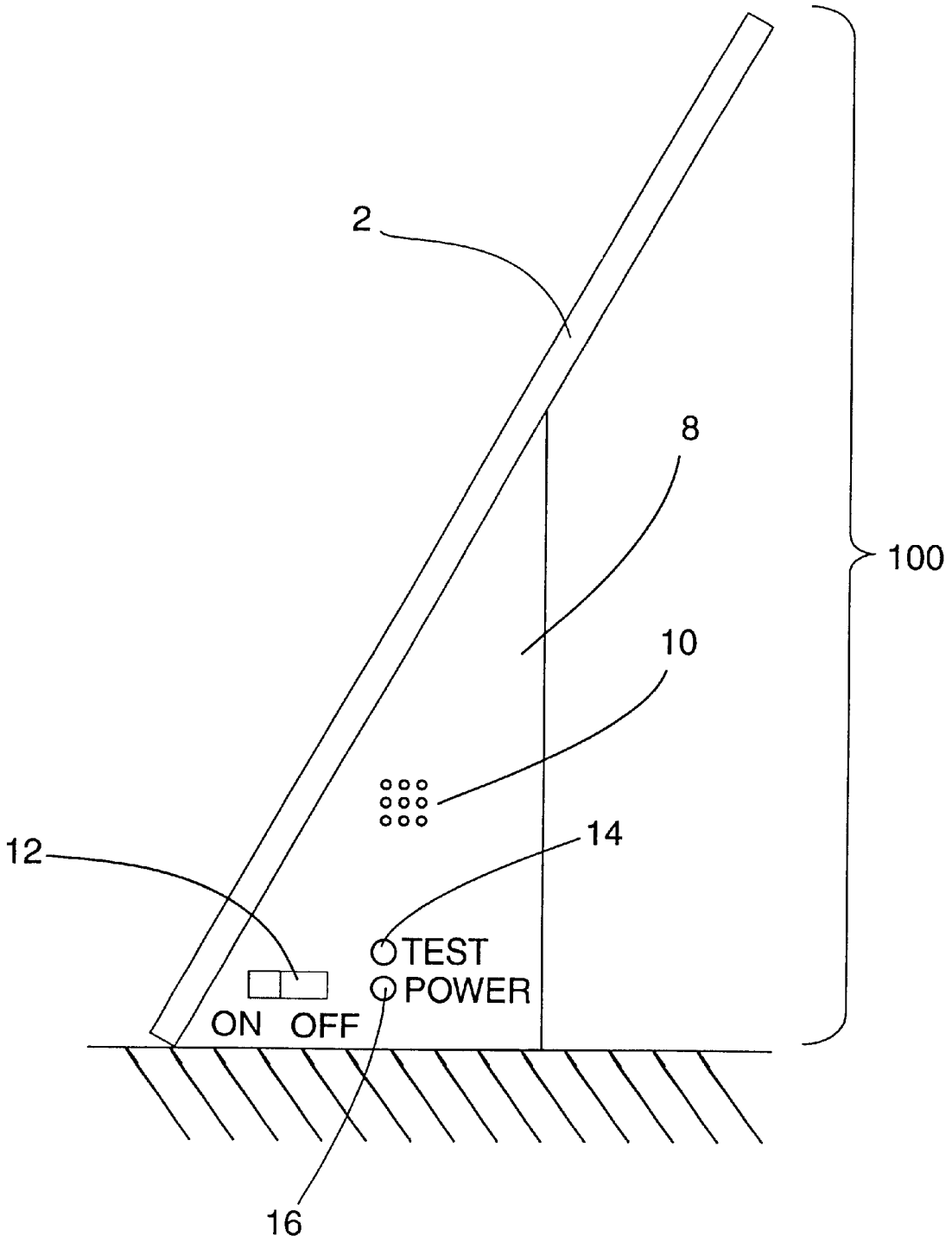
FIG. 2 is a side view of the alarm tester of the present invention.
Figure 3:
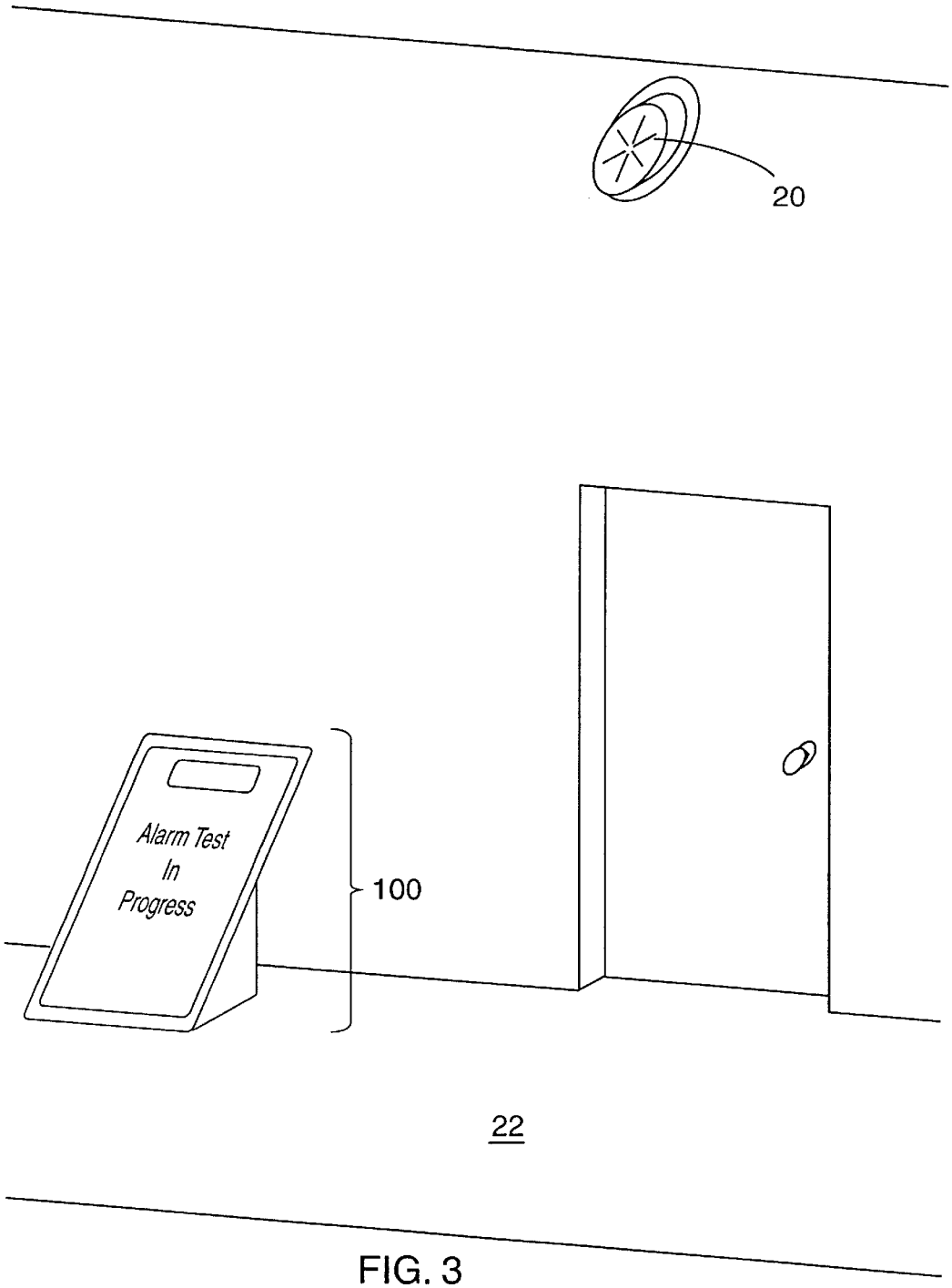
FIG. 3 is a perspective view of the present invention in use.

Referring now to FIG. 1 we see a front view of the alarm tester of the present invention 100. Front panel 2 is flat and roughly rectangular in shape. Printed on panel 2 is a message 6 indicating that an alarm test is taking place and an additional message 7 warning unauthorized persons not to remove the testing device 100. The upper central part of panel 2 is cut out 4 and acts as a hand hold device. The entire assembly 100 rests on hall floor 8. FIG. 2 is a side view of the present invention 100. Housing 8 encloses the electronic components that make the unit work. An on/off switch 12 is located at the bottom right. When the unit 100 is turned on a green LED 16 is activated to show that the unit is working. When a test is complete, test light 14 should be lit indicating that the alarm had gone off during the test. The triangular shape of the side of housing 8 helps hold up attached graphic panel 2. Apertures 10 lead to internal microphone 30. FIG. 3 shows the unit 100 in place in a hallway 22 during a test. It is placed within 10 feet of the alarm 20. One of these alarm testing devices 100 would be placed at every alarm location in the building to be tested. The inspector would then go to the central alarm activation station and briefly, about one second, try each alarm. The inspector would then go back and retrieve the testers, looking at the red test light 14 to see if the alarm worked or not.

Figure 4:
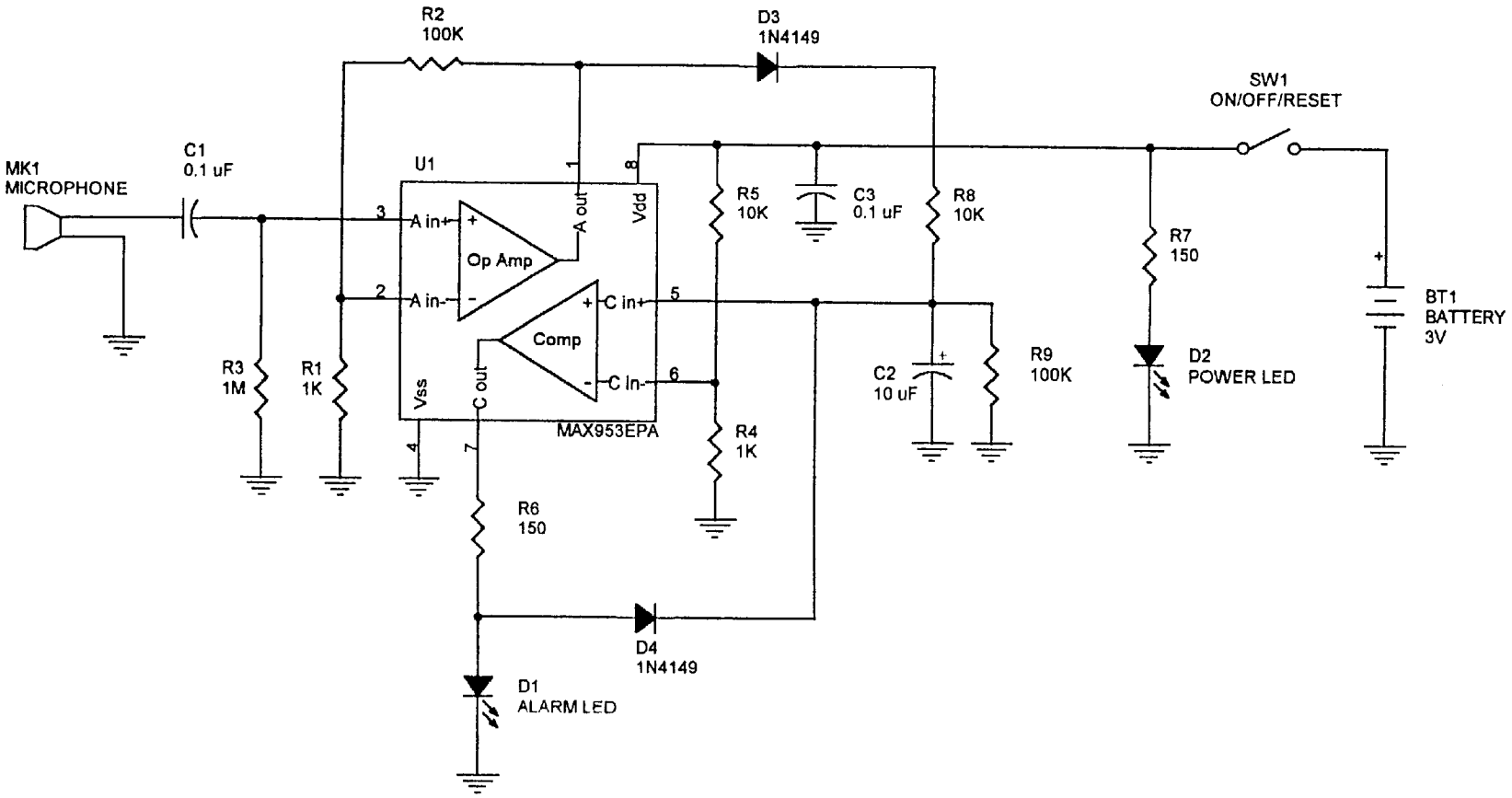
FIG. 4 is a schematic drawing of the circuit of the present invention.
Figure 5:
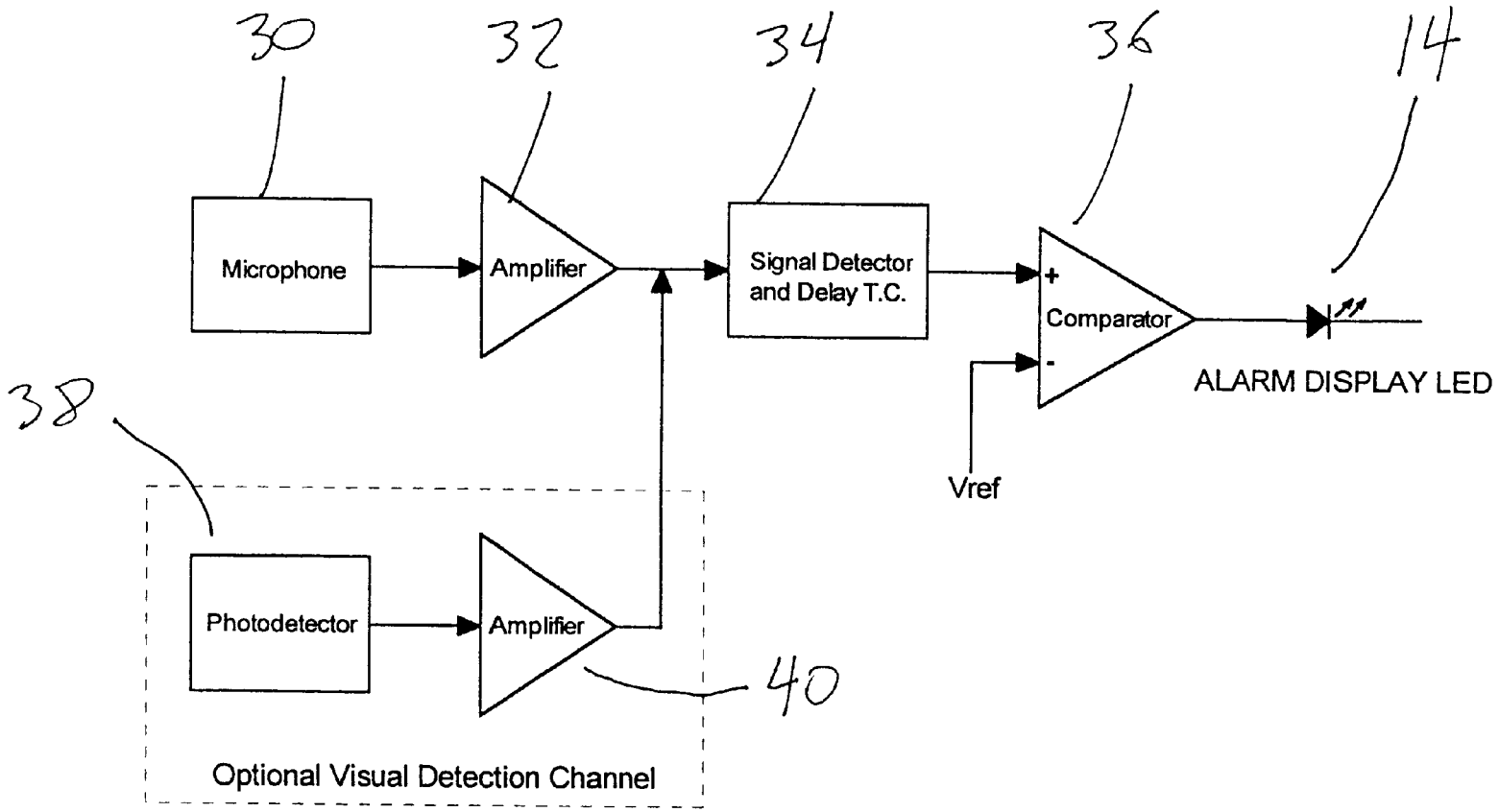
FIG. 5 is a block diagram of the operation of the present invention.

FIG. 5 shows a block diagram of the electronic circuit of the present invention. Microphone 30 picks up the sound of the alarm and sends it to amplifier 32. Amplified signal 32 goes to signal detector 34 which includes a delay circuit that helps eliminate false readings such as slamming doors. The sound level is then compared to a reference signal in circuit 36 and finally, if the sound level is above seventy five decibels, the alarm display LED 14 is activated. Alternately, an optical sensor 38 can be added to test for strobe light alert devices that are used for people who are hearing impaired. FIG. 4 is a schematic view of the circuit of the present invention 100.

In the above described and illustrated ways, an alarm inspector can inspect a plurality of alarms within a relatively short time with relatively little effort as compared to current methods.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A remote alarm tester for indicating if an alarm has sounded, the remote alarm tester comprising:

a graphic display panel having an test light, an electronic sound sensing device attached to said graphic display panel, said sound sensing device designed and configured to activate said test light when a sound of a selected decibel level or greater has occurred within a selected distance of said remote alarm tester, wherein once said test light has been activated by said electronic sound sensing device said test light remains lit until said test light is reset by a user.

2. The remote alarm tester of claim 1, wherein said test light is an LED.

3. The remote alarm tester of claim 1, wherein said sound sensing device is designed and configured to activate said test light when a sound of seventy-five decibels or greater has occurred within a ten foot distance of said remote alarm tester.

4. The remote alarm tester of claim 1, wherein said graphic display panel also displays information that communicates to passerby that an inspection is taking place and to not temper with said remote alarm tester.

5. The remote alarm tester of claim 1, wherein said sound sensing device, said graphic display, a battery and a microprocessor chip are located within a housing having a switch.

6. The remote alarm tester of claim 4, wherein said switch turns the remote alarm tester on and off.

7. The remote alarm tester of claim 1, further comprising a visual detection device attached to said graphic display panel, said visual detection device designed to detect strobe warning lights, said graphic display also indicating if said strobe warning lights were detected, the indication continuing until said remote alarm tester is reset by the user.

8. A remote alarm tester for indicating if an alarm has sounded, the remote alarm tester comprising:

a graphic display panel having an LED light, an electronic sound sensing device attached to said graphic display panel, said sound sensing device designed and configured to activate said LED light when a sound of seventy-five decibels or greater has occurred within a ten foot distance of said remote alarm tester, and a switch connected with said LED light, wherein once said LED light has been activated by said electronic sound sensing device said LED light remains lit until said LED light is reset by a user.

9. The remote alarm tester of claim 8, wherein said graphic display panel also displays information that communicates to passersby that an inspection is taking place and to not tamper with said remote alarm tester.

10. The remote alarm tester of claim 8, wherein said sound sensing device, said graphic display, a battery and a microprocessor chip are located within a housing having a switch.

11. The remote alarm tester of claim 8, further comprising a visual detection device attached to said graphic display panel, said visual detection device designed to detect strobe warning lights, said graphic display also indicating if said strobe warning lights were detected, the indication continuing until said remote alarm tester is reset by the user.

12. A remote alarm tester, comprising:

a graphic display panel having an attached electronic sound sensing device;

said sound sensing device being capable of activating an LED light when a sound of seventy-five Db or greater has occurred within a ten foot distance of said remote alarm tester;

said graphic display card also displaying pictorial and language elements that communicate to passersby that an inspection is taking place and to not tamper with the sensing device;

and a visual detection device attached to said graphic display panel, said visual detection device designed and configured to detect strobe warning lights for the hearing impaired.

13. A method of testing an alarm comprising the steps of:

(a) placing an alarm tester within range of an audible alarm, (b) activating the audible alarm, thereby causing an indicator, which is attached to the alarm tester to indicate that the alarm has sounded, (c) deactivating the audible alarm, (d) and after step (c), checking the alarm tester to check if said indicator is active to determine if the audible alarm sounded.

14. The method of claim 13 wherein step (d) is accomplished by checking to see if a test light is lit.

15. The method of claim 13, further comprising the step of resetting alarm tester.

16. The method of claim 13, wherein said audible alarm is used in conjunction with a visual alarm and said indicator also indicates if the visual alarm was activated.

* * * * *